US009348286B2

(12) United States Patent
Takahashi

(10) Patent No.: US 9,348,286 B2
(45) Date of Patent: May 24, 2016

(54) PRINTING APPARATUS, PRINTING APPARATUS CONTROL METHOD, AND STORAGE MEDIUM FOR PERFORMING BACKGROUND COLOR REMOVAL

(71) Applicant: CANON KABUSHIKI KAISHA, Tokyo (JP)

(72) Inventor: Toru Takahashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/510,012

(22) Filed: Oct. 8, 2014

(65) Prior Publication Data

US 2015/0104201 A1 Apr. 16, 2015

(30) Foreign Application Priority Data

Oct. 11, 2013 (JP) ..... 2013-213641

(51) Int. Cl.
*G03G 15/00* (2006.01)
*G03G 15/23* (2006.01)

(52) U.S. Cl.
CPC ..... *G03G 15/5025* (2013.01); *G03G 15/234* (2013.01); *G03G 15/5062* (2013.01)

(58) Field of Classification Search
CPC ..... G03G 15/5025; G03G 15/234; G03G 15/5062; G03G 2215/00586; G03G 15/23; G03G 15/231
See application file for complete search history.

(56) References Cited

U.S. PATENT DOCUMENTS 5,055,946 A * 10/1991 Kurahashi et al. ..... 358/498
8,233,202 B2 * 7/2012 Chen et al. ..... 358/498
8,870,182 B2 * 10/2014 Ogata et al. ..... 271/225
8,885,226 B2 * 11/2014 Oishi ..... 358/3.28
8,928,951 B2 * 1/2015 Utsunomiya ..... 358/461
8,934,114 B2 * 1/2015 Utsunomiya ..... 358/1.14
8,970,928 B2 * 3/2015 Arakawa ..... 358/498
8,976,419 B2 * 3/2015 Kakutani et al. ..... 358/3.24
8,995,028 B2 * 3/2015 Kato et al. ..... 358/474
9,016,688 B2 * 4/2015 Miyamoto et al. ..... 271/227
9,019,518 B2 * 4/2015 Takayama et al. ..... 358/1.13
9,019,580 B2 * 4/2015 Odaira ..... 358/521
9,030,684 B2 * 5/2015 Saito ..... 358/1.13
9,055,173 B2 * 6/2015 Shinto
2008/0266622 A1 * 10/2008 Kawazoe et al. ..... 358/498
2009/0080034 A1 * 3/2009 Yamagishi ..... G03G 15/5025 358/465
2009/0161124 A1 * 6/2009 Tamura ..... H04N 1/4095 358/1.1
2012/0113443 A1 * 5/2012 Itoh ..... H04N 1/4095 358/1.9
2013/0293903 A1 * 11/2013 Nakatsuka ..... 358/1.9
2013/0293907 A1 * 11/2013 Aoki et al. ..... 358/1.12
2013/0293908 A1 * 11/2013 Takahashi ..... 358/1.12
2013/0293909 A1 * 11/2013 Endo et al. ..... 358/1.12
2013/0293930 A1 * 11/2013 Araki et al. ..... 358/3.24
2013/0294785 A1 * 11/2013 Takahashi ..... 399/21
2013/0294795 A1 * 11/2013 Tamura et al. ..... 399/82

(Continued)

FOREIGN PATENT DOCUMENTS

JP 5-183749 A 7/1993
JP 8-237485 A 9/1996

(Continued)

*Primary Examiner* — David Gray
*Assistant Examiner* — Laura Roth
(74) *Attorney, Agent, or Firm* — Canon USA, Inc. IP Division

(57) ABSTRACT

An offset image that can occur at a time when reading images printed on both sides of a sheet is automatically removed by a simple operation.

5 Claims, 12 Drawing Sheets

(56) References Cited

U.S. PATENT DOCUMENTS

| | | | | |
|---|---|---|---|---|
| 2013/0301067 | A1* | 11/2013 | Nakamura | H04N 1/00037 358/1.13 |
| 2014/0079456 | A1* | 3/2014 | Nakajima et al. | 399/367 |
| 2014/0079457 | A1* | 3/2014 | Nakajima et al. | 399/367 |
| 2014/0320873 | A1* | 10/2014 | Kato et al. | 358/1.12 |
| 2014/0320940 | A1* | 10/2014 | Ino et al. | 358/498 |
| 2014/0321897 | A1* | 10/2014 | Ogata et al. | 399/373 |
| 2015/0002887 | A1* | 1/2015 | Kato | B41J 3/60 358/1.14 |

FOREIGN PATENT DOCUMENTS

| | | | |
|---|---|---|---|
| JP | 2000-185881 | A | 7/2000 |
| JP | 2001-91621 | A | 4/2001 |

* cited by examiner

PRINTING APPARATUS, PRINTING APPARATUS CONTROL METHOD, AND STORAGE MEDIUM FOR PERFORMING BACKGROUND COLOR REMOVAL

BACKGROUND OF THE INVENTION

1. Field of the Invention

The present invention relates to a printing apparatus, a printing apparatus control method, and a storage medium.

2. Description of the Related Art

Conventionally, when a copying machine and a multifunctional image forming apparatus read an image, background color removal processing has been employed as a technique for preventing so-called offset reproduced on a front side by an image that is on the back side of a document. In background color removal, a user performs gradation correction on read image information according to a level for decreasing an image reproduction density that is specified from an operation screen or according to a background color level estimated from a histogram of the luminance or density level of the read image information. Since the quality of the read image can deteriorate depending on this level, especially with respect to a background color level, techniques for increasing the estimation accuracy of the background color level have been proposed (Japanese Patent Application Laid-Open Nos. 5-183749 and 8-237485).

However, since the characteristics of the histogram differ depending on various factors, such as the type of image printed on the document, the paper thickness of the document, and the irradiation intensity of the light source, an estimation error will necessarily occur.

Further, rather than estimating the background color level from a histogram, the optimum background color level can also be determined by reading a document printed on only a back side, and using a result obtained by reading only the image that is actually offset, as discussed in Japanese Patent Application Laid-Open No. 2001-91621.

However, in a conventional image forming apparatus, the document conveyance system of a document conveyance type image reading unit and the printing sheet conveyance system of the unit that prints an image onto a printing sheet are configured independent of each other. Consequently, a troublesome user operation is required. More specifically, the background color level is determined by reading in advance a document printed on only one side (pre-scanning). Then, printing is performed on the other side, and then again the document printed on both sides needs to be read.

SUMMARY OF THE INVENTION

According to an aspect of the present invention, a printing apparatus includes a first conveyance unit configured to convey a document via a first path to a reading unit, a printing unit configured to print an image on a front side or a back side of a conveyed sheet, a second conveyance unit configured to convey a sheet on which an image has been printed on a front face or a back face of the sheet, to the reading unit via a second path and the first path, a determination unit configured to determine a background color level from a back-side image or a front-side image read by the reading unit from the sheet conveyed by the second conveyance unit, and an image processing unit configured to perform background color removal on the back-side image or the front-side image read and stored by the reading unit from the printed sheet based on the background color level determined by the determination unit.

Further features of the present invention will become apparent from the following description of exemplary embodiments with reference to the attached drawings.

DESCRIPTION OF THE EMBODIMENTS

Various exemplary embodiments, features, and aspects of the invention for carrying out the present invention will be described in detail below with reference to the drawings.

Description of the System Configuration

Figure 1:
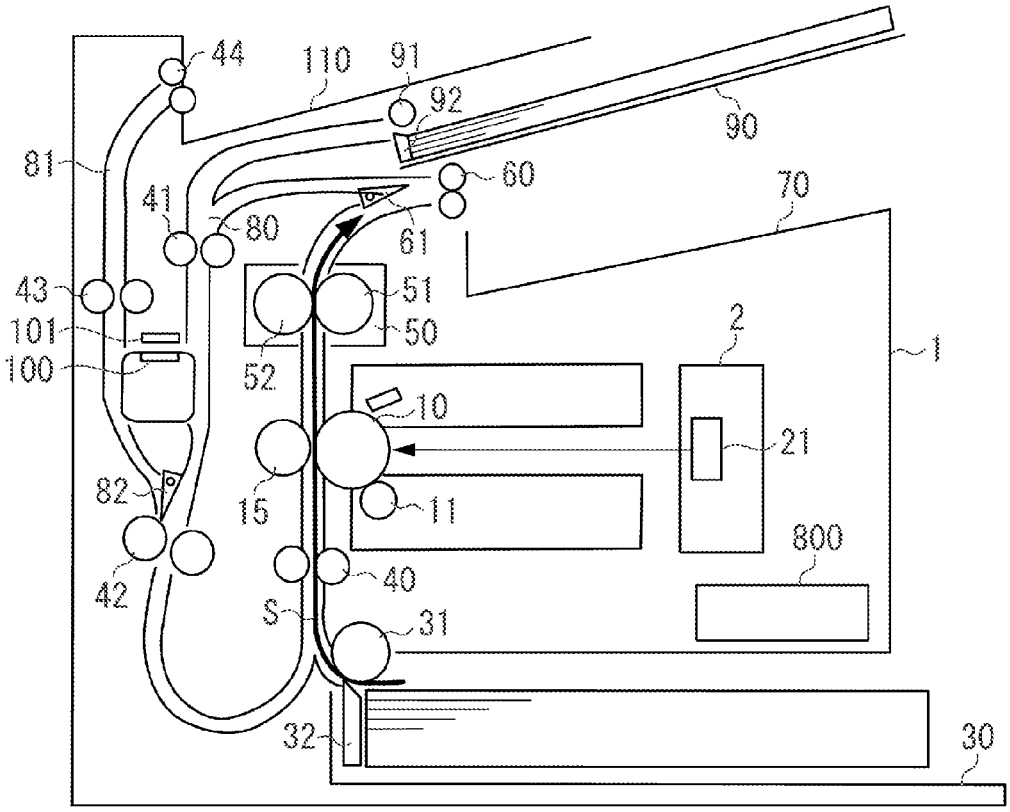
FIG. 1 is a cross-sectional view of a printing apparatus illustrating an exemplary embodiment.

FIG. 1 is a schematic diagram of a multifunctional image forming apparatus in which the printing apparatus according to a first exemplary embodiment is employed.

In FIG. 1, in the center of a printing apparatus 1, there are a rotatable photosensitive drum 10 serving as an image bearing member, and a development roller 11 that is arranged in parallel with the photosensitive drum 10 so as to contact each other and is configured to rotate while holding a toner. When a printing signal is received, a light emitting unit 21 included in an optical unit 2 radiates laser light on a surface of the rotating photosensitive drum 10. The surface of the photosensitive drum 10 irradiated with the laser light forms a latent image of an electric charge. When the toner held by the development roller 11 is supplied onto the latent image on the surface of the photosensitive drum 10 while the development roller 11 is rotating, a toner image is formed on the surface of the photosensitive drum 10.

On the other hand, recording sheets S contained in a first sheet feed unit 30 are conveyed one by one to conveyance rollers 40 by a pickup roller 31 and a separation unit 32. The conveyance rollers 40 convey a recording sheet S to a transfer unit 15 such that the toner image on the surface of the photosensitive drum 10 is timed to the leading edge of the recording sheet S.

The toner image conveyed to the transfer unit 15 by the rotation of the photosensitive drum 10 is transferred onto the recording sheet S by a voltage bias applied to the transfer unit 15 and pressure. Further, the transfer unit 15 conveys the recording sheet S to a fixing unit 50. At the fixing unit 50, the toner image is fixed on the recording sheet S by the heat from a rotatable heating roller 51 and the pressure of a rotatable pressure roller 52 that opposes the heating roller 51. The recording sheet S on which the toner image has been fixed is conveyed to discharge rollers 60. In the case of one-sided printing, the discharge rollers 60 convey the recording sheet S as it is to the outside of the apparatus, and the recording sheet S is stacked on a first sheet discharge unit 70.

Further, the document reading processing, image processing, printing and the like performed by the printing apparatus 1 are controlled by a controller 800 that will be described below with reference to FIG. 8.

FIGS. 2 to 7 are cross-sectional views of the printing apparatus according to the present exemplary embodiment.

Two-sided printing performed by the printing apparatus according to the present exemplary embodiment will now be described with reference to FIG. 2.

Figure 2:
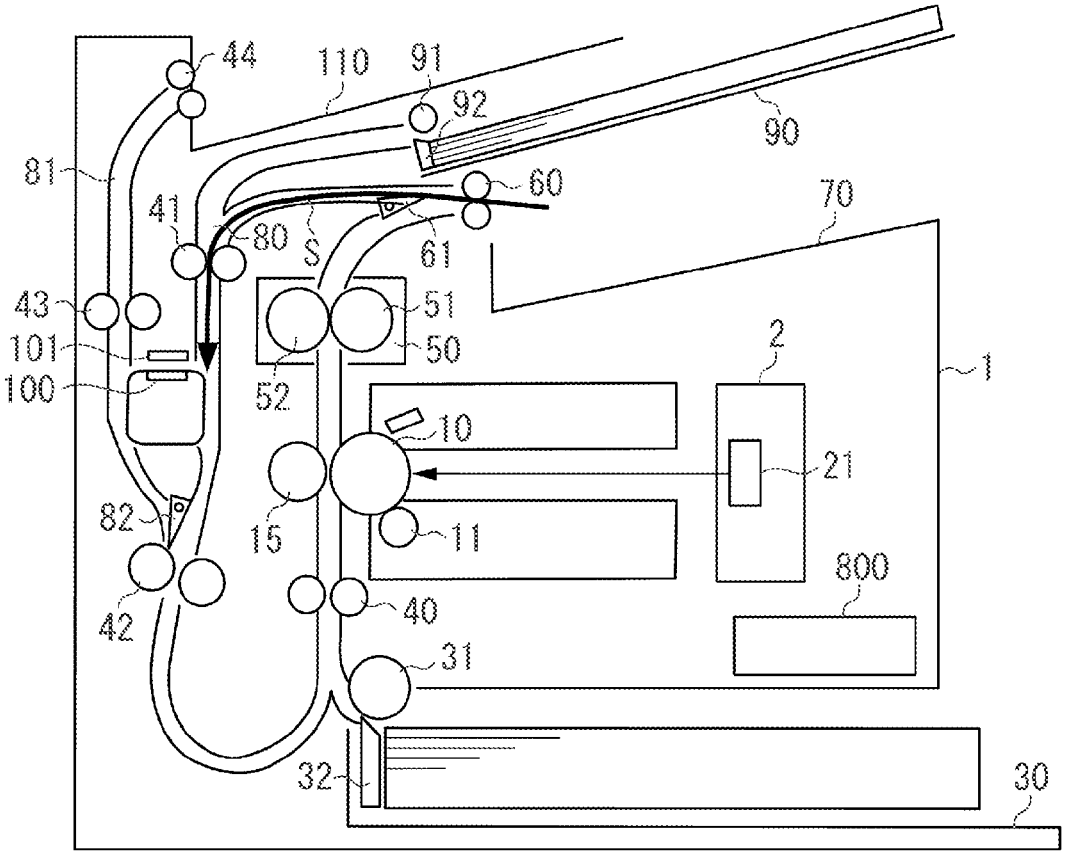
FIG. 2 is a cross-sectional view of a printing apparatus illustrating an exemplary embodiment.

In FIG. 2, a two-sided flapper 61 switches the conveyance path after a trailing edge of the recording sheet S has passed. Thereafter, the discharge rollers 60 are rotated in reverse, and convey the recording sheet S to a conveyance path 80 via a second path. The switched-back recording sheet S is conveyed via conveyance rollers 41 to a document reading unit 100. Then, the recording sheet S is conveyed to conveyance rollers 42 and the conveyance rollers 40, and again conveyed to the transfer unit 15. Then, the toner image is transferred and fixed, and the recording sheet S is stacked on the first discharge unit 70. A first path and the second path are related such that the first path is a bypassed to the second path. Therefore, in the present exemplary embodiment, the conveyance path 80 conveying a document G is used as the first path, and the path that heads from the discharge rollers 60 toward the conveyance path 80 functions as the second path. Consequently, the apparatus is configured such that the recording sheet S can be temporarily conveyed through the first path from the second path.

Next, reading the document surface and two-sided printing on the recording sheet will be described with reference to FIGS. 3 and 4. In the present exemplary embodiment, the image recorded on the side to be printed first on the recording sheet will be referred to as "front-side image", and the image recorded on the inverted side of the recording sheet will be referred to as "back-side image".

Figure 3:
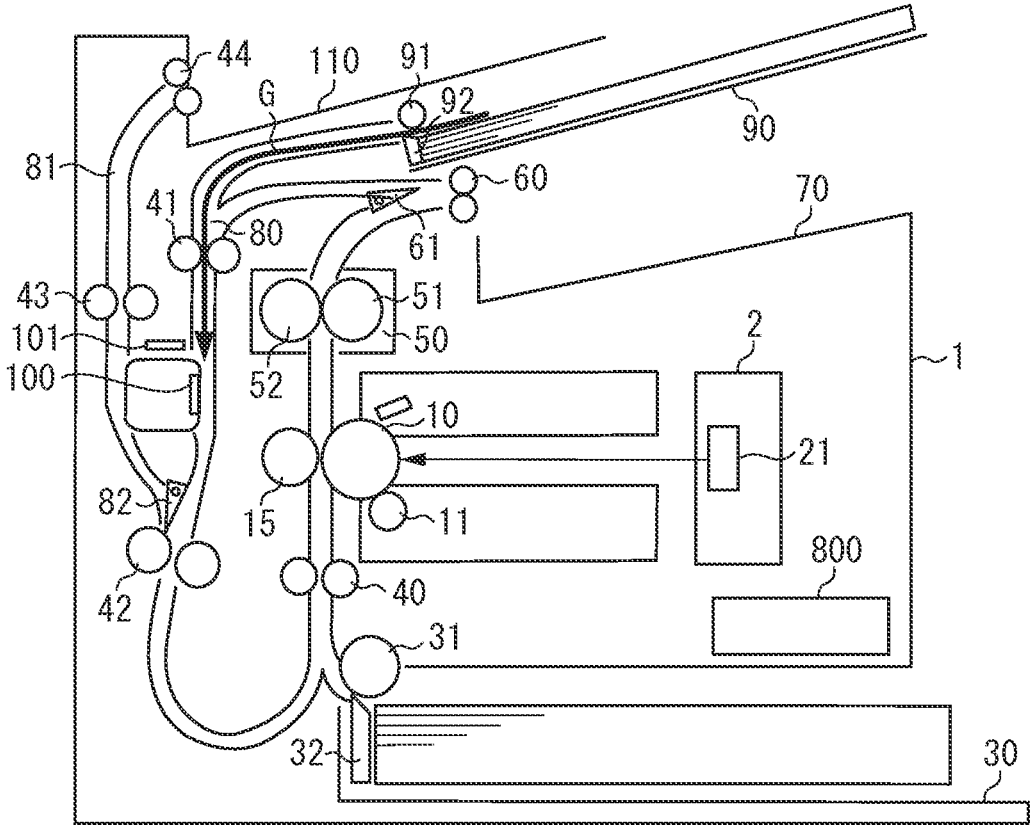
FIG. 3 is a cross-sectional view of a printing apparatus illustrating an exemplary embodiment.

In FIG. 3, documents G contained in a second sheet feed unit 90 are conveyed one by one via the first path to the conveyance rollers 41 by a pickup roller 91 and a separation unit 92. Meanwhile, the document reading unit 100 emits light onto a white reference member 101 by the time when reading of the first side, which is the document front side, of a document G fed from the second sheet feed unit 90 starts. The document reading unit 100 corrects a white reference value, and then rotates to a position facing the conveyance path 80.

The conveyance rollers 41 convey the document G to the document reading unit 100. The document reading unit 100 is already waiting at a position facing the conveyance path 80. The information read by the document reading unit 100 is stored as information about the document first side in an image memory 804, which will be described in detail below with reference to FIG. 8. Further, the white reference member 101 is arranged facing downwards as a countermeasure against dust adherence.

Figure 4:
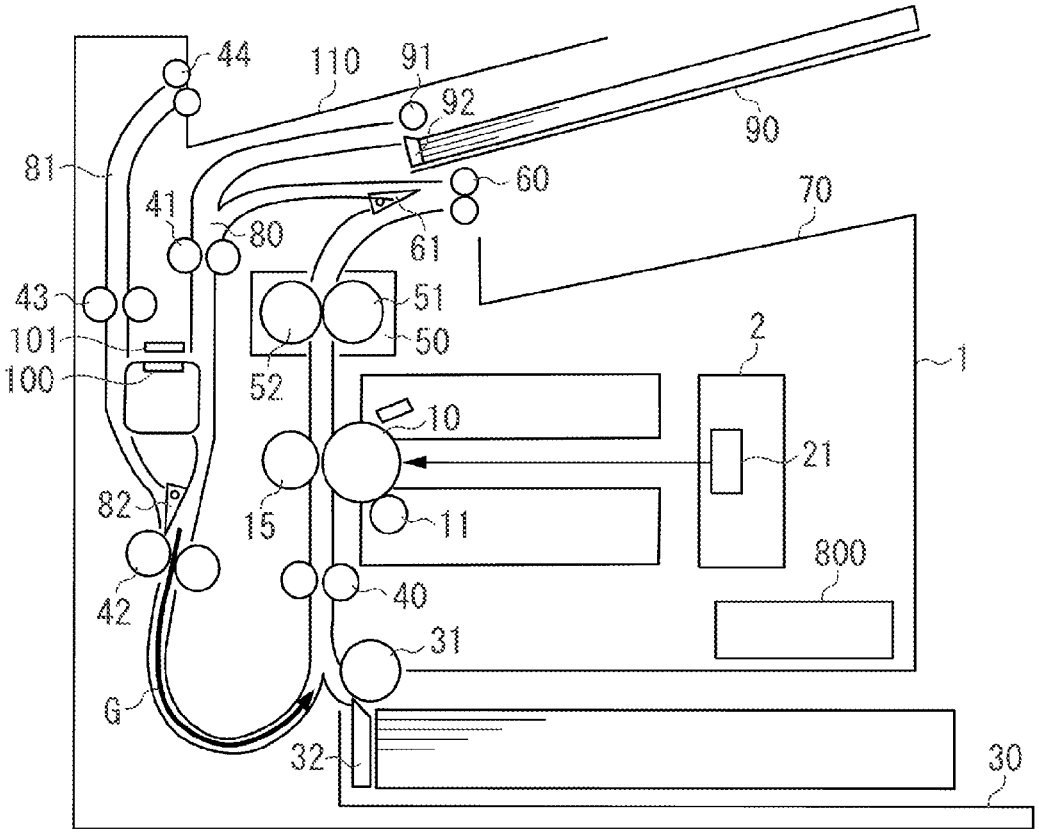
FIG. 4 is a cross-sectional view of a printing apparatus illustrating an exemplary embodiment.

FIG. 4 illustrates a state where reading of the first side, which is the document front side, has finished.

In FIG. 4, a document G that has passed through the document reading unit 100 is conveyed to the conveyance rollers 42. The conveyance rollers 42 stop when the trailing edge of the document G has passed through a switchback flapper 82. Therefore, the document G stops in a state in which it is sandwiched between the conveyance rollers 42. After a predetermined duration has elapsed, the document G is conveyed to a conveyance path 81.

Figure 5:
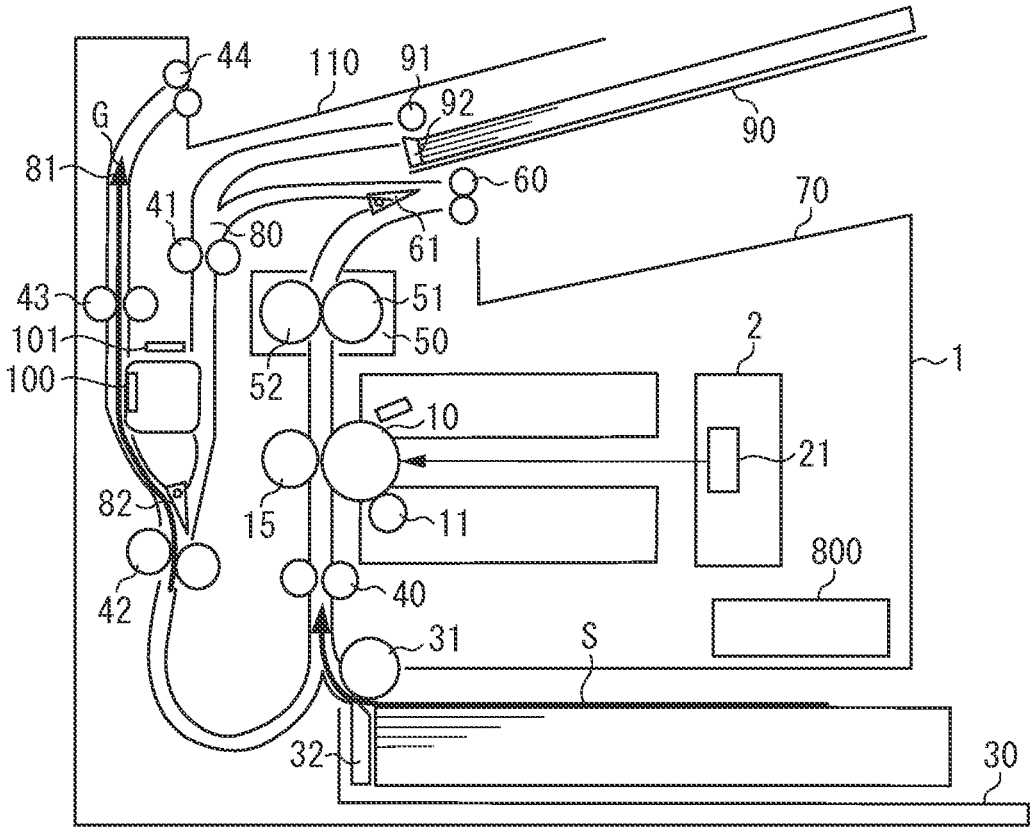
FIG. 5 is a cross-sectional view of a printing apparatus illustrating an exemplary embodiment.

FIG. 5 illustrates a state where reading of the second side, which is the document back side, starts.

In FIG. 5, the switchback flapper 82 switches the path from the conveyance path 80 to the conveyance path 81, and at the same time, the document reading unit 100 rotates to a position facing the conveyance path 81. When the conveyance rollers 42 are rotated in reverse, the document G is conveyed to the document reading unit 100 along the conveyance path 81.

The document G is conveyed to and passes through the document reading unit 100, and thereby information about the second side, which is the document back side, is read and stored in the image memory 804. The recording sheets S fed from the first sheet feed unit 30 are conveyed one by one to the conveyance rollers 40. A latent image is formed on the photosensitive drum 10 by the light emitting unit 21 based on the image information about the second side that is almost simultaneously stored in the image memory 804. Next, a toner image formed from the latent image is transferred by the transfer unit 15, and the recording sheet S is then conveyed through the fixing unit 50 and the like to complete image formation of the document second side.

Although in FIG. 5 the feeding of the recording sheet S starts when the reading of the information about the second side starts, the recording sheet S may also be conveyed after the information about the second side has been read.

Figure 6:
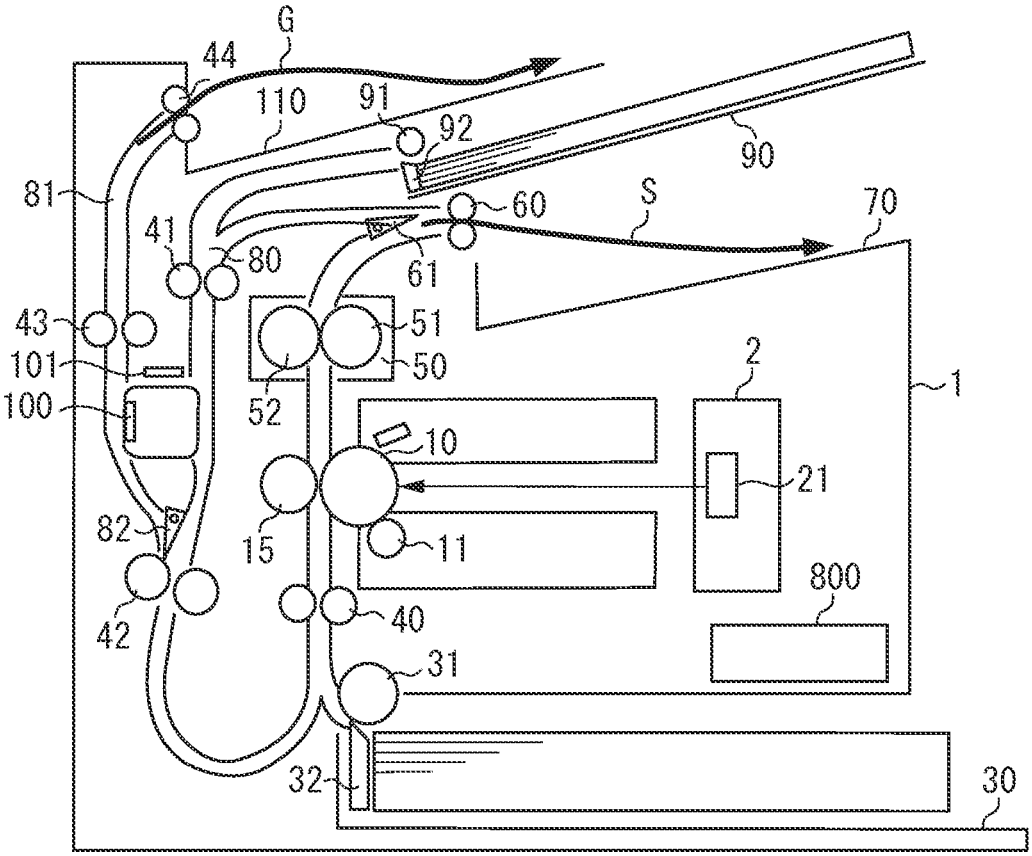
FIG. 6 is a cross-sectional view of a printing apparatus illustrating an exemplary embodiment.

FIG. 6 illustrates a state where reading of the document back side has finished.

In FIG. 6, the document G for which image reading has finished is conveyed to conveyance rollers 43 and 44, and is stacked on a second sheet discharge unit 110. When the trailing edge of the document G passes through the switchback flapper 82, the switchback flapper 82 switches the path from the conveyance path 81 to the conveyance path such that the recording sheet S is conveyed in the direction of the conveyance rollers 40. The recording sheet S for which image formation of the document second side has been completed is conveyed by the reverse rotation of the conveyance rollers 60 toward the conveyance path 80 to which the path is switched by the two-sided flapper 61.

Figure 7:
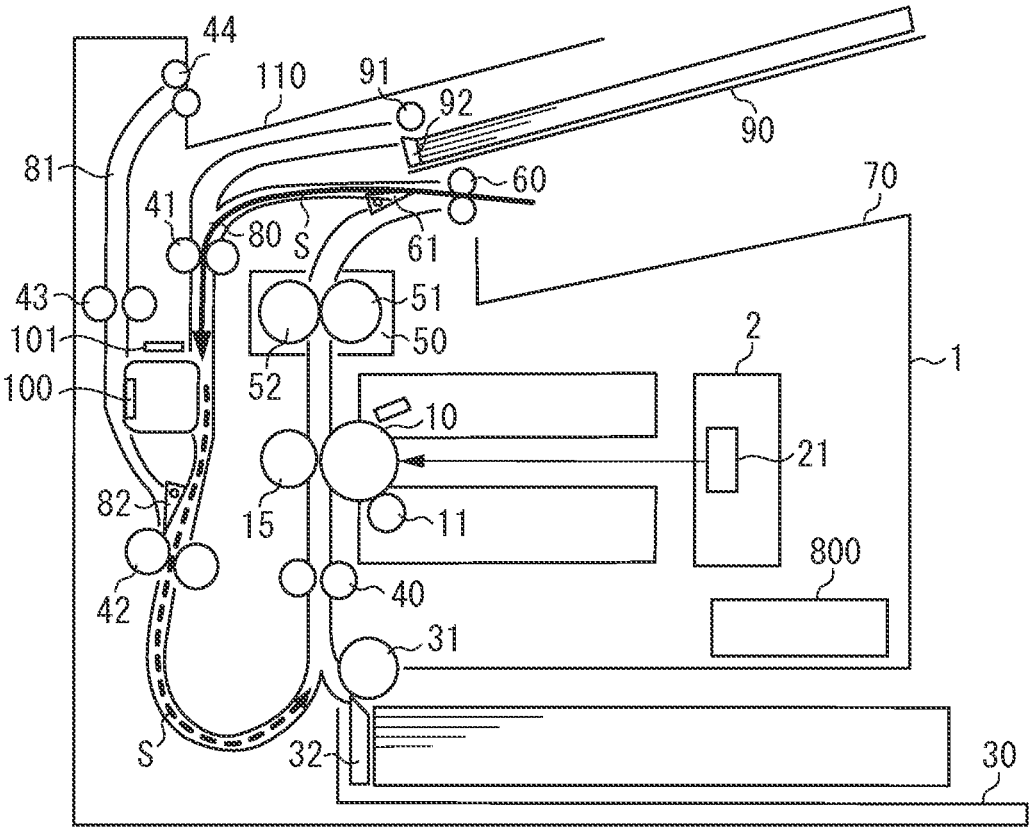
FIG. 7 is a cross-sectional view of a printing apparatus illustrating an exemplary embodiment.

FIG. 7 illustrates a state in which image formation on the recording sheet S has been completed.

In FIG. 7, the recording sheet S conveyed to the conveyance path 80 passes through the inverted document reading unit 100, and is conveyed via the conveyance rollers 42 to the conveyance rollers 40. The recording sheet S is then again conveyed to the transfer unit 15, as illustrated by the dotted line. Then, based on the image information about the document first side stored in the image memory 804, the toner image is transferred onto and fixed to the recording sheet S by an image forming unit configured from the optical unit 2, the photosensitive drum 10, the development roller 11, the transfer unit 15, and the fixing unit 50. The recording sheet S is then stacked on the first sheet discharge unit 70.

Next, a process will be described in which two-sided printing is performed on a recording sheet, and at the same time, images printed on both sides of the recording sheet are read.

Image formation is performed on one side of the recording sheet S in the same manner as described above with reference to FIG. 1. After the trailing edge of the recording sheet S has passed through the two-sided flapper 61, the two-sided flapper 61 switches the conveyance path in the same manner as described above with reference to FIG. 2. Then, the discharge rollers 60 are rotated in reverse, and the recording sheet S is conveyed to the conveyance path 80. The switched-back recording sheet S is conveyed via the conveyance rollers 41 to the document reading unit 100.

On the other hand, the document reading unit 100 emits light onto the white reference member 101 by the time when the recording sheet S is conveyed, and after performing white reference value correction, rotates to a position facing the conveyance path 80. When the recording sheet S arrives, the document reading unit 100 is already waiting at a position facing the conveyance path 80. The information read by the document reading unit 100 is stored in the image memory 804, which will be described in detail with reference to FIG. 8. The recording sheet S conveyed at that time does not have an image formed on the side facing the document reading unit 100 (the image reading side). An image will be formed on the other side.

Consequently, at that time only the image information that is actually offset can be read. Then, the recording sheet S is conveyed to the conveyance rollers 42 and 40, again conveyed to the transfer unit 15, and the toner image is transferred and fixed to form images on both sides of the recording sheet S. After the trailing edge of the recording sheet S has passed through the two-sided flapper 61, the two-sided flapper 61 switches the conveyance path. The discharge rollers 60 are then rotated in reverse to convey the recording sheet S to the conveyance path 80. Hereinafter, the images formed on both sides of the recording sheet S is read in the same manner as the process of the two-sided document described with reference to FIGS. 3 to 6.

Further, after the recording sheet S on which an image has been formed on one side has been conveyed to the conveyance path 80, the process in which simultaneously with printing on the one side of the recording sheet, the image of the one side printed on the recording sheet is read is the same as the process described with reference to FIG. 4.

Figure 8:
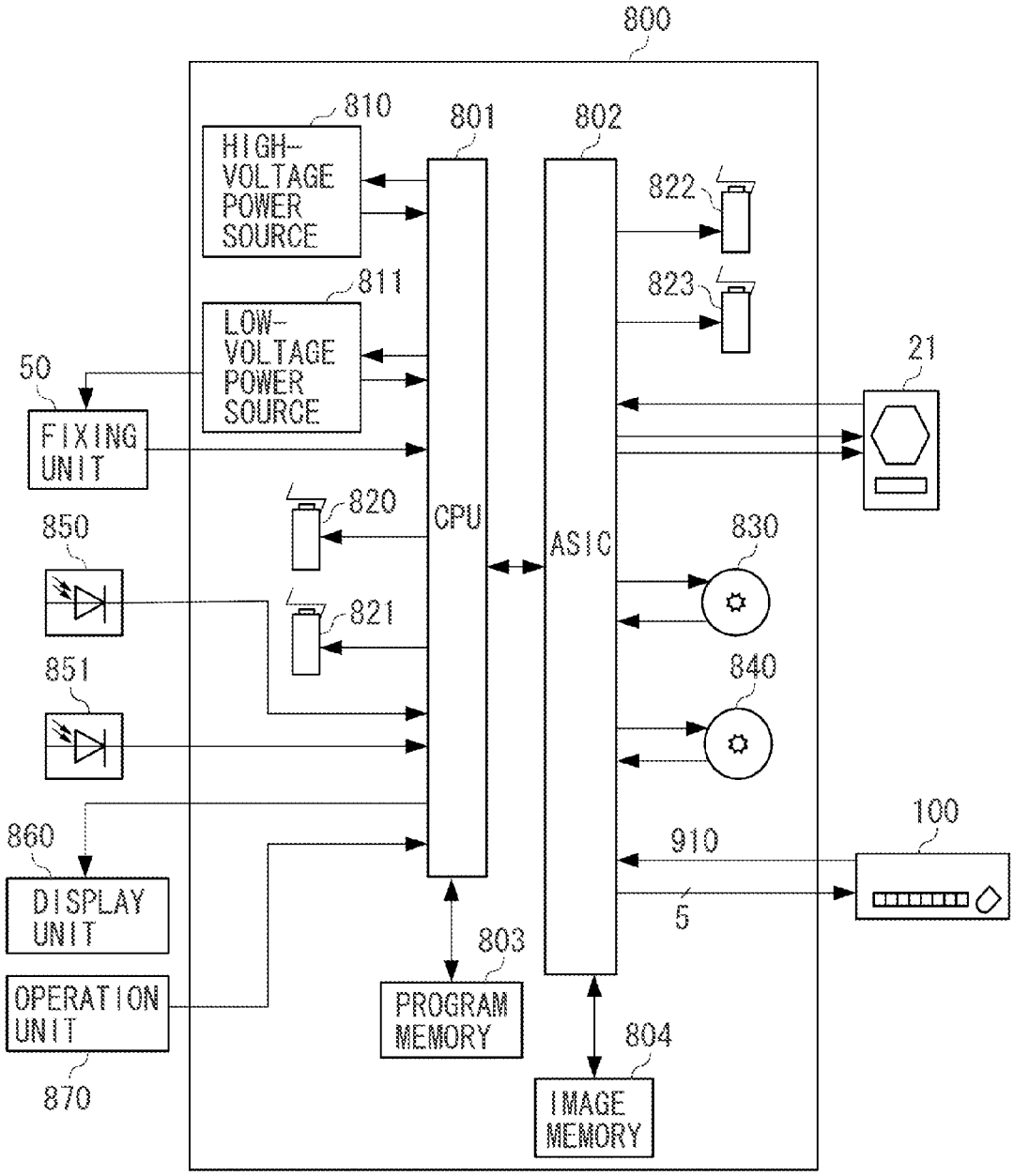
FIG. 8 is a block diagram illustrating a control configuration of a printing apparatus.

FIG. 8 is a block diagram illustrating a control configuration of the printing apparatus according to the present exemplary embodiment. The operations of a central processing unit (CPU) 801 and an application specific integrated circuit (ASIC) 802 in the image formation operation of the printing apparatus 1 will now be described.

In FIG. 8, the CPU 801 is connected via the ASIC 802 to a light emitting unit 21 that includes a polygon mirror, a motor, and a light emitting element. To render a desired latent image by scanning laser light on the surface of the photosensitive drum 10, the CPU 801 controls the optical unit 2 by outputting a control signal to the ASIC 802. Similarly, the CPU 801 controls a main motor 830 for driving the pickup roller 31 and the conveyance rollers 40, which convey the recording sheet S, and driving the photosensitive drum 10, the transfer unit 15, the heating roller 51, the pressure roller 52, and the discharge rollers 60. Further, the CPU 801 controls a recording sheet feed solenoid 822 that is turned on at the time when the driving of the sheet feed roller for feeding the recording sheet S starts to drive the pickup roller 31, and a drive motor 840 for driving the pickup roller 91 and the conveyance rollers 41 to 44.

The CPU 801 also controls a high-voltage power source 810, which controls the primary charging, development, primary transfer, and secondary transfer bias required for an electrophotographic process, as well as the fixing unit 50 and a low-voltage power source 811. In addition, the CPU 801 monitors the temperature with a thermistor (not illustrated) provided in the fixing unit 50, and maintains and controls the fixing temperature at a predetermined level.

Further, the CPU 801 is connected via a bus (not illustrated), for example, to a program memory 803. The programs and data for executing the above-described controls and all or a part of processing by the CPU 801 in each of the exemplary embodiments described in the present specification are stored in the program memory 803. Namely, the CPU 801 executes the operations according to the respective exemplary embodiments of the present invention using program and data stored in the program memory 803.

Based on instructions from the CPU 801, the ASIC 802 performs internal motor speed control of the light emitting unit 21, and speed control of the main motor 830 and the drive motor 840. Motor speed control is performed by detecting a tach signal (a pulse signal output from the motor every time the motor is rotated) from the motor (not illustrated), and outputting an acceleration or a deceleration signal to the motor such that the interval between tach signals is a predetermined duration. Thus, configuring the control circuit from an ASIC 802 hardware-based circuit has the merit of reducing the control load on the CPU 801.

When a print command issued from a host computer (not illustrated) or an operation unit 870 is received, the CPU 801 conveys the recording sheet S by driving the main motor 830, the drive motor 840, and the recording sheet feed solenoid 822.

After the toner image formed on the surface of the photosensitive drum 10 has been transferred by the transfer unit 15, the toner image is fixed by the fixing unit 50, and the recording sheet S is then discharged to the first sheet discharge unit 70 by the discharge rollers 60.

To increase the alignment property of the recording sheets for which image formation has finished, the first sheet discharge unit 70 has a gentle upward slope from near the discharge aperture toward the sheet discharge direction. The CPU 801 generates heat in a desired amount and applies it to the recording sheet S by supplying a predetermined amount of power via the low-voltage power source 811 to the fixing unit 50, so that the toner image on the recording sheet melts and is fixed thereto.

Next, a document reading operation in the printing apparatus according to the present exemplary embodiment will be described.

When a scan command issued from the host computer (not illustrated) or the operation unit 870 is received, the CPU 801 drives a two-sided flapper solenoid 820 and the drive motor 840 to operate a document sheet feed solenoid 823. Consequently, the CPU 801 transmits the torque from the drive motor 840 to the pickup roller 91 and conveys the document G. Further, the document reading unit 100 is connected to the ASIC 802. The CPU 801 stores, in the image memory 804 connected to the ASIC 802, image data read from the document reading unit 100 via the ASIC 802 based on various controls.

Then, the CPU 801 operates a switchback solenoid 821 so as to push the switchback flapper 82 down to the conveyance path 81 side, invert the drive motor 840, and convey the document G to the second sheet discharge unit 110. Alternatively, the CPU 801 can convey the document G toward the transfer unit 15 by driving the conveyance rollers 40 via the drive motor 840 without performing the above-described operation of the switchback solenoid 821. Further, when a copy command transmitted from the operation unit 870 is received, the CPU 801 controls the above-described printing operation and document reading operation together.

In addition, the CPU 801 performs the above-described printing operation based on an instruction from the host computer (not illustrated) or the operation unit 870, and conveys the recording sheet S to the document reading unit 100 without discharging the recording sheet S to the discharge unit.

The document reading unit 100 then reads the image printed on the recording sheet S in the same manner as the above-described document reading operation.

A display unit 860 includes light-emitting diodes (LEDs) or a liquid crystal display. The CPU 801 displays operation information from the operator and an internal state of the apparatus on the display unit 860. The operation unit 870 receives operations from the operator. The operation unit 870 may include a plurality of buttons, or can also be realized as a touch display together with the display unit 860.

Figure 9:
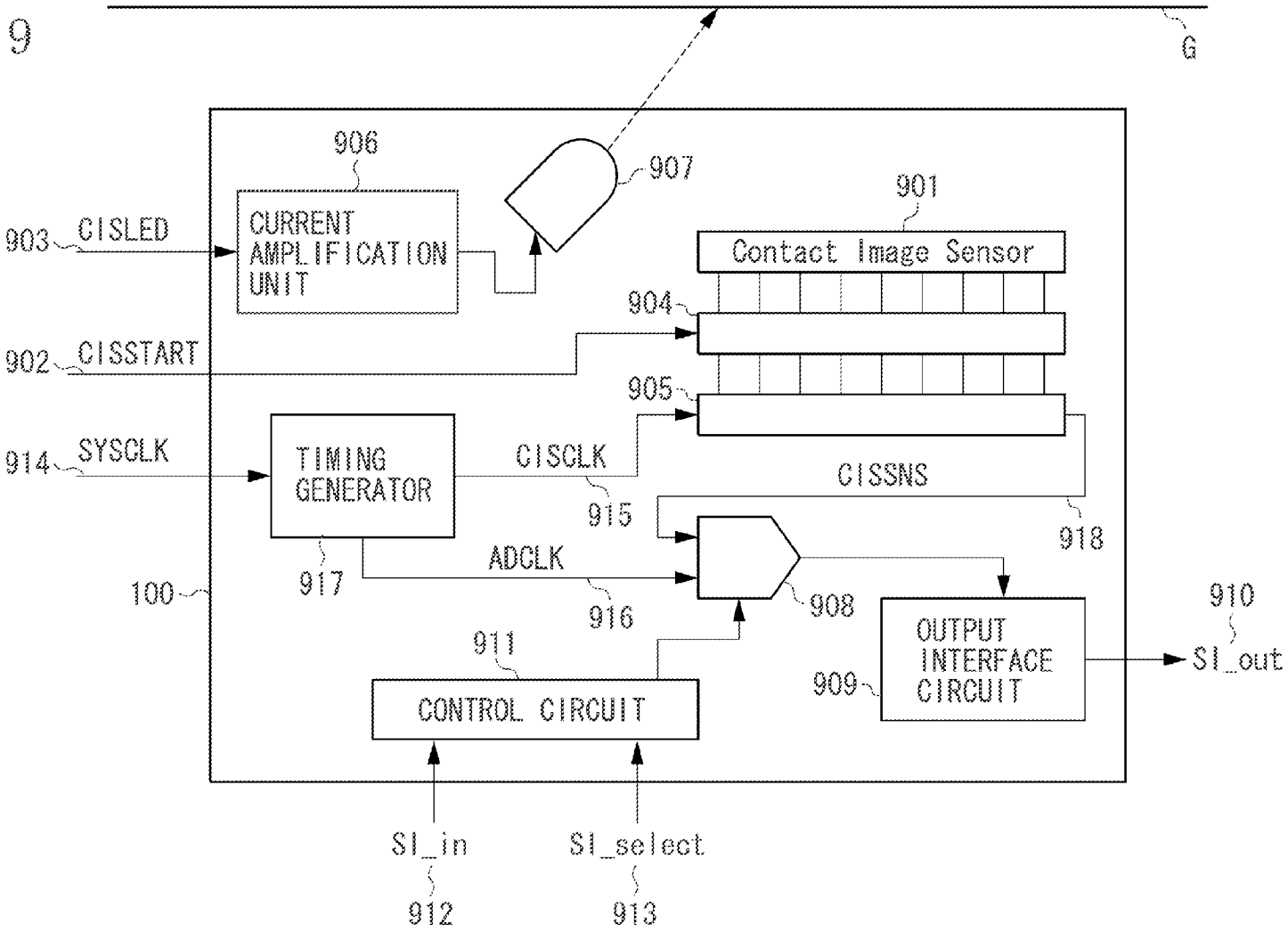
FIG. 9 illustrates a configuration of an image reading unit included in a printing apparatus.

FIG. 9 illustrates a configuration of the document reading unit 100 illustrated in FIG. 1. In this example, the reading unit is configured from a contact image sensor (CIS).

In FIG. 9, for example, photodiodes corresponding to 10,368 pixels are arranged in an array at a specific main-scanning density (e.g., 1200 dpi) on a contact image sensor 901 (image sensor). A start pulse signal (CISSTART signal) 902 is input to an output buffer 904 of the image sensor 901. A transfer clock CISCLK 915 is input to a shift register 905 of the image sensor 901.

A system clock SYSCLK 914 determines the operation speed of the CIS sensor. The document reading unit 100 also includes an A/D converter 908 and a timing generator 917. A CIS sampling clock ADCLK 916 determines the sampling speed.

A light emitting element control signal 903 is input to a current amplifying unit 906. A light emitting element 907 radiates light uniformly onto the document G to be conveyed. The document reading operation will now be described with reference to FIG. 9.

When the CISSTART signal 902 illustrated in FIG. 9 is activated, the image sensor unit 901 starts accumulation of electric charge based on the received reflected light from the document, and sequentially sets data in the output buffer 904.

Next, when the transfer clock CISCLK 915 (e.g., approximately 500 kHz to 1 MHz) is applied, the data set in the output buffer 904 is transferred to the A/D converter 908 as a CISSNS signal 918 by the shift register 905. Since the CISSNS signal 918 includes a predetermined data assurance area, the sampling has to be performed after a predetermined duration has elapsed since the rise of the transfer clock CISCLK 915. Further, the CISSNS signal 918 is output in synchronization with both the rising and the falling edges of the transfer clock CISCLK 915.

Consequently, the frequency of the CIS sampling clock ADCLK 916 is generated so as to be twice the frequency of the transfer clock CISCLK 915, and the CISSNS signal 918 is sampled at the rising edge of the CIS sampling clock ADCLK 916. The timing generator 917 generates the CIS sampling clock ADCLK 916 and the transfer clock CISCLK 915 by frequency-dividing the system clock SYSCLK 914. The phase of the CIS sampling clock ADCLK 916 is delayed compared with the transfer clock CISCLK 915 by an amount corresponding to the data assurance area.

The CISSNS signal 918 that has been digitally converted by the A/D converter 908 is output as serial data to an S1_out signal 910 at a predetermined timing under the control of an output interface circuit 909. At that time, an analog output reference voltage is indicated in the CISSNS signal 918 for a predetermined number of pixels from the start pulse CISSTART signal 902, and these cannot be used as effective pixels.

Moreover, an A/D conversion gain of the A/D converter 908 can be variably controlled by the control circuit 911 based on an S1_in signal 912 and an S1_select signal 913.

For example, if the contrast of a captured image cannot be obtained, the CPU 801 can increase the contrast by increasing the A/D conversion gain of the A/D converter 908 so that images are always captured at an optimum contrast.

In the present exemplary embodiment, although a system has been described in which all of the pixels are output as one output signal (CISSNS signal) 918, the pixels may be divided into areas for high-speed reading, and A/D conversion may be performed simultaneously on this plurality of areas. Further, although the present invention has been described above using a CIS sensor for the document reading unit 100, a complementary metal oxide semiconductor (CMOS) sensor, a charge-coupled device (CCD) sensor and the like may be used instead.

Figure 10:
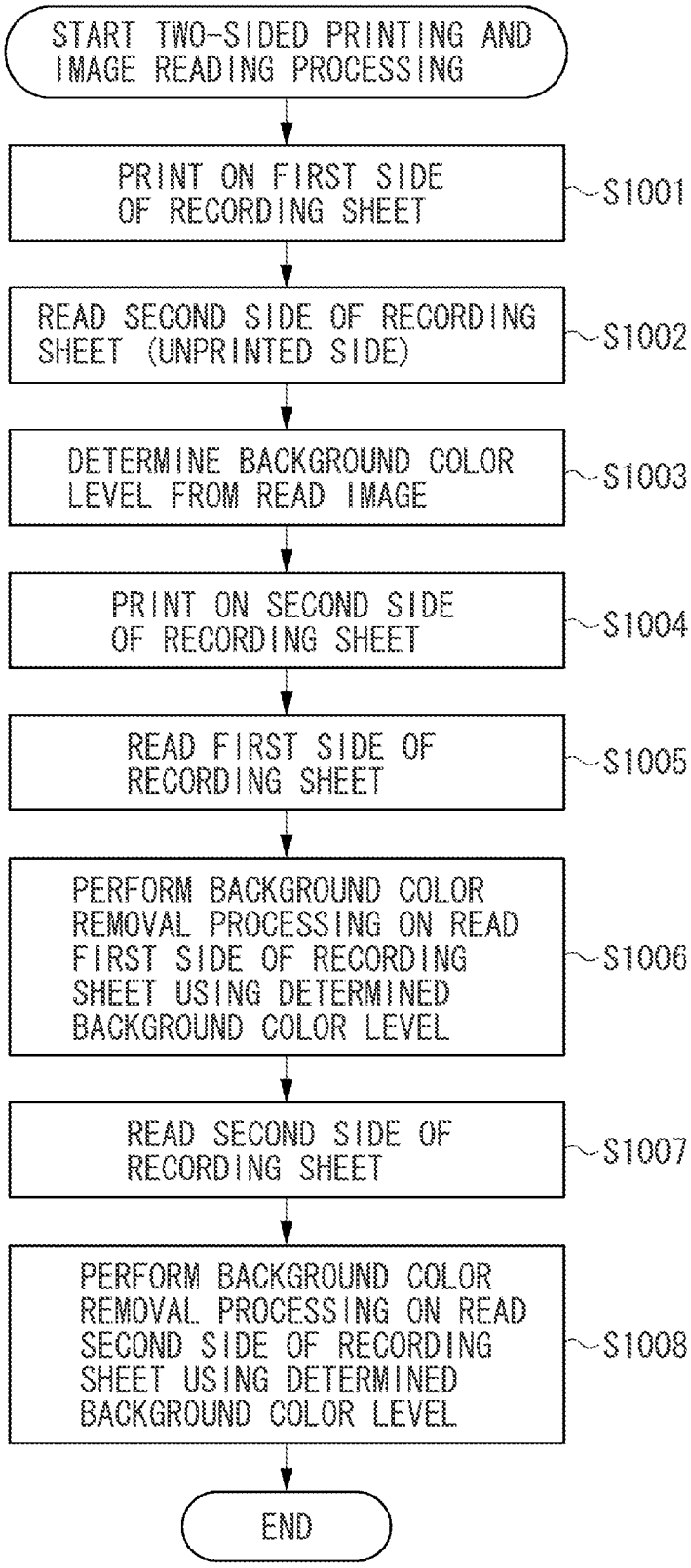
FIG. 10 is a flowchart illustrating a printing apparatus control method.

FIG. 10 is a flowchart illustrating a method for controlling the printing apparatus according to the present exemplary embodiment. This is an example of a process for printing both sides of a recording sheet and at the same time reading images printed on the sides of the recording sheet. Further, a control program corresponding to each step is stored in the program memory 803. The CPU 801 executes the control program, and thereby this control is realized. The images printed at this time will be described below in conjunction with FIG. 11, which illustrates an example of an image to be read.

In step S1001, the CPU 801 conveys a recording sheet S contained in the first sheet feed unit 30 toward the transfer unit 15 and the fixing unit 50, and forms (prints) an image on the first side of the recording sheet S. At this time, an image 1101 is printed on the first side of the recording sheet S, for example.

Figure 11:
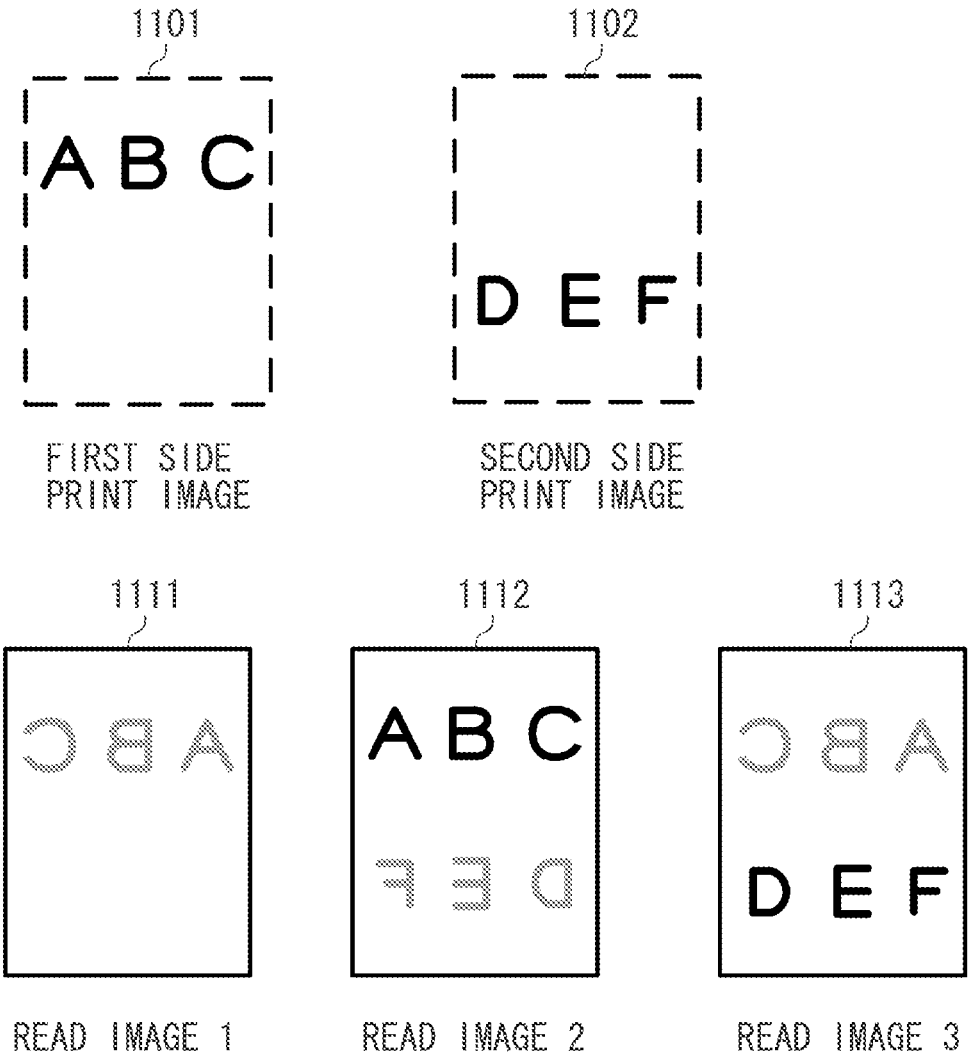
FIG. 11 illustrates an example of an image of a document read by an image reading unit.

Next, in step S1002, the CPU 801 switches back the recording sheet S by rotating the discharge rollers 60 in reverse, conveys the recording sheet S to the document reading unit 100, and reads the second side (i.e., the face on which an image has not yet been formed at this time) of the recording sheet S with the document reading unit 100. An image 1111 that may be read at this time is illustrated in FIG. 11. The content offset by the image 1101 printed on the first side is read. In step S1003, the CPU 801 generates a histogram related to the luminance level from the image read in step S1002, and sets the minimum luminance value as a background color level.

Figure 12:
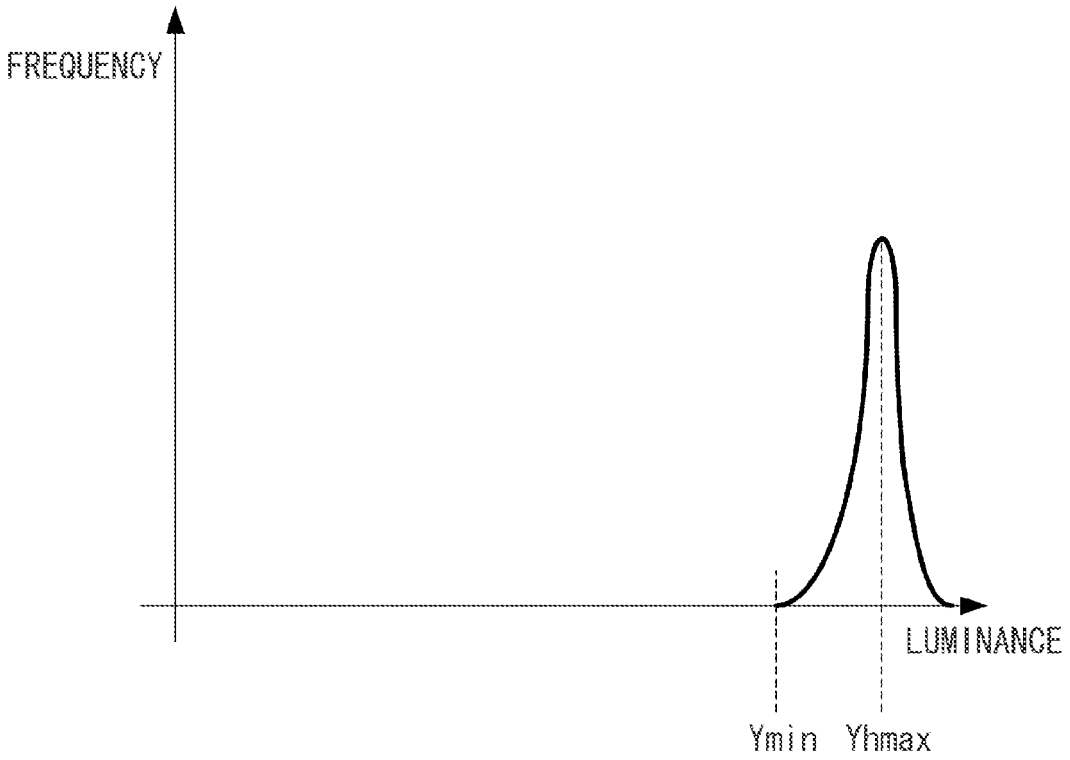
FIG. 12 illustrates a luminance characteristic of an image of a document read by an image reading unit.

FIG. 12 illustrates an example of a histogram of the luminance levels obtained from a read image, in which the minimum luminance value Ymin is determined as the background color level. In FIG. 12, the vertical axis represents frequency and the horizontal axis represents luminance.

The luminance value at which frequency in the luminance level histogram is maximum (Yhmax in FIG. 12) may also be set as the background color level. Further, the CPU 801 can also generate a histogram of the density levels from the read image, and determine the background color level based on this density histogram. In addition, the background color level can also be determined for each color component in the read image data. Consequently, the present invention can also be employed when printing on a non-white color sheet.

The CPU 801 stores the determined background color level in the program memory 803 or the image memory 804, and deletes the image data read in step S1002 from the image memory 804.

Next, in step S1004, the CPU 801 performs control such that the recording sheet S is again conveyed toward the transfer unit 15 and the fixing unit 50, and forms an image on the second side of the recording sheet S. At this time, an image 1102 is printed on the second side of the recording sheet S, for example.

In step S1005, the CPU 801 similarly switches the recording sheet S back, conveys the recording sheet S to the document reading unit 100, and reads the first side of the recording sheet S. An image 1112 may be read at this time. The content of the image 1101 printed on the first side and the content offset by the image 1102 printed on the second side are read.

Then, in step S1006, the CPU 801 performs background color removal on the image read in step S1005 using the background color level determined in step S1003. This background color removal may be performed by the ASIC 802. Further, as the background color removal performed at this time, the density of the read image data can be corrected using a density conversion table provided in advance for each background color level. The CPU 801 can also removes the background color by variably controlling the A/D conversion gain of the A/D converter 908 based on the background color level.

The CPU 801 can also remove the background color by correcting the gradation of the read image by changing the irradiation intensity of the light emitting element 907 based on the background color level. Further, the CPU 801 can also remove the background color by utilizing the print image data of the first side used in step S1001 and the print image data of the second side used in step S1004 stored in the image memory 804. In addition, the CPU 801 can remove the background color based on correction that also takes into account the type of image (e.g., a photograph, characters etc.) to be printed on the recording sheet S.

Next, in step S1007, the CPU 801 performs control such that the recording sheet S is conveyed to the conveyance path 81 and the document reading unit 100 rotates to a position facing the conveyance path 81, and the CPU 801 reads an image of the second side of the recording sheet S. An image 1113 may be read at this time. The content of the image 1102 printed on the second side and the content offset by the image 1101 printed on the first side are read.

Then, in step S1008, the CPU 801 performs background color removal on the image read in step S1007 using the background color level determined in step S1003, and finishes the processing. Further, similar to step S1006, the above-described background color removal may also be performed by the ASIC 802.

Consequently, in a sheet that has images printed on both sides, the images on both sides of the sheet can be read in a single process in a state in which the influence of background color caused by the offset on the other side, of an image printed on one side is removed.

Further, in a printing apparatus in which a document conveyance system and a printing sheet conveyance system are shared, printing on the printing sheet and reading of the printed image can be successively performed without a user's troublesome task. In addition, due to detection of the accurate background color level, the quality of the read image can be improved.

A processing device (a CPU, or a processor) in a PC (a computer), for example, executes software (a program) acquired via a network or various storage media, and thereby, each of the steps in the present invention can also be realized.

The present invention is not limited to the above-described exemplary embodiments, and may be variously modified (including various organic combinations of the exemplary embodiments) according to the gist of the present invention. Such modifications do not go beyond the scope of the present invention.

OTHER EMBODIMENTS

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blue-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-213641 filed Oct. 11, 2013, which is hereby incorporated by reference herein in its entirety.

What is claimed is:

1. A printing apparatus comprising:

a printing unit configured to print an image on a sheet;

a reading unit configured to read the image printed on the sheet; and a control unit configured to:

control the printing unit to print a first image on a first surface of the sheet, control the reading unit to read, after the first image is printed on the first surface and before a second image is printed on a second surface of the sheet, the second surface in order to obtain a first reading result, determine a background color level based on the obtained first reading result, control the printing unit to print, after the first reading result is obtained, the second image on the second surface, control the reading unit to read, after the second image is printed on the second surface, the second surface in order to obtain a second reading result, and perform, based on the determined background color level, background color removal on the obtained second reading result which corresponds to the second image printed on the second surface.

2. The printing apparatus according to claim 1, wherein the control unit is configured to generate a luminance level histogram or a density level histogram to determine the background color level.

3. The printing apparatus according to claim 1, wherein the reading unit is a contact image sensor.

4. A method for controlling a printing apparatus, the method comprising:

printing a first image on a first surface of a sheet;

reading, after the first image is printed on the first surface and before a second image is printed on a second surface of the sheet, the second surface in order to obtain a first reading result;

determining a background color level based on the obtained first reading result;

printing, after the first reading result is obtained, the second image on the second surface;

reading, after the second image is printed on the second surface, the second surface in order to obtain a second reading result; and performing, based on the determined background color level, background color removal on the obtained second reading result which corresponds to the second image printed on the second surface.

5. A non-transitory computer-readable storage medium in which is stored a program that makes a computer execute a method for controlling a printing apparatus, the method comprising:

printing a first image on a first surface of a sheet;

reading, after the first image is printed on the first surface and before a second image is printed on a second surface of the sheet, the second surface in order to obtain a first reading result;

determining a background color level based on the obtained first reading result;

printing, after the first reading result is obtained, the second image on the second surface;

reading, after the second image is printed on the second surface, the second surface in order to obtain a second reading result; and performing, based on the determined background color level, background color removal on the obtained second reading result which corresponds to the second image printed on the second surface.

* * * * *